US006829452B2

(12) United States Patent
Tanimoto et al.

(10) Patent No.: US 6,829,452 B2
(45) Date of Patent: Dec. 7, 2004

(54) IMAGE FORMING APPARATUS AND DEVELOPING DEVICE

(75) Inventors: Takeshi Tanimoto, Kawasaki (JP); Kenji Yagi, Hyogo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/050,173

(22) Filed: Jan. 18, 2002

(65) Prior Publication Data

US 2002/0061209 A1 May 23, 2002

Related U.S. Application Data

(63) Continuation of application No. PCT/JP99/03946, filed on Jul. 23, 1999.

(51) Int. Cl.[7] ..... G03G 21/00; G03G 15/08; G03G 15/09

(52) U.S. Cl. ..... 399/98; 399/103; 399/267

(58) Field of Search ..... 399/98, 102, 103, 399/105, 119, 222, 252, 267, 274, 284

(56) References Cited

U.S. PATENT DOCUMENTS 4,338,880 A * 7/1982 Tabuchi et al. ..... 399/103
4,377,334 A * 3/1983 Nishikawa ..... 399/103
5,001,517 A * 3/1991 Hosaka et al. ..... 399/274 X
5,327,339 A * 7/1994 Takeda et al. ..... 399/267 X
5,659,861 A * 8/1997 Yamashita et al. ..... 399/267
5,758,240 A * 5/1998 Ito et al. ..... 399/267

FOREIGN PATENT DOCUMENTS

| | | |
|---|---|---|
| JP | 52-50243 | 4/1977 |
| JP | 56-99364 | 8/1981 |
| JP | 61-27152 | 2/1986 |
| JP | 61-176567 | 11/1986 |
| JP | 62-89081 | 4/1987 |
| JP | 62-74256 | 5/1987 |
| JP | 63-311284 | 12/1988 |
| JP | 1-102588 | 4/1989 |
| JP | 4-264473 | 9/1992 |
| JP | 4-281480 | 10/1992 |
| JP | 4-307572 | 10/1992 |
| JP | 09-034265 A * | 2/1997 |

* cited by examiner

*Primary Examiner*—Sandra Brase
(74) *Attorney, Agent, or Firm*—Westerman, Hattori, Daniels & Adrian, LLP

(57) ABSTRACT

A clearance regulating amount L by a clearance regulating member 4, which is provided above a developing roller 3 on a side closer to a photosensitive drum 1, is determined at a size not greater than a height T of a developer at a magnetic pole just downstream of the clearance regulated position. Thus, the scattering of the developer from a developing unit 2 is significantly reduced.

7 Claims, 10 Drawing Sheets

IMAGE FORMING APPARATUS AND DEVELOPING DEVICE

This application is a continuation of PCT/JP99/03946 filed Jul. 23, 1999.

BACKGROUND OF THE INVENTION

1. Field of the Invention

The present invention relates to an image forming apparatus and a developing device used in the image forming apparatus for copying machines, facsimile machines, printers and other information processing systems, which utilize an electrophotographic process wherein a visual image is produced on a photosensitive member by a developer by use of electrostatic attraction, and the visual image is transferred to a sheet.

2. Discussion of Background

In an image forming apparatus wherein a visual image is produced on a photosensitive member 1*a* by a developer, such as a toner, and the visual image is transferred onto a material for transfer, such as a sheet, conveyed along a conveyance path M as shown in FIG. 17, a developing unit 2 has a cover 203 provided, with a certain clearance, above a developing roller 3 for causing the developer to adhere to a latent image on the photosensitive member 1*a* as shown in FIG. 18.

When the rotational direction of the developing roller 3 in the developing unit 2 is set such that the developing roller rotates in a direction against gravity at a contacting point of the developing unit 2 with or a point of the developing unit closest to the photosensitive member 1*a,* air is introduced into the developing unit 2 through the clearance above the developing roller 3 by rotation of the developing roller 3 as shown in FIG. 18 to increase the air pressure in the developing unit 2, causing the air in the developing unit 2 to be discharged through a gap of the developing unit 2 or lateral gaps at both ends of the developing roller 3. Concomitantly, some part of the developer stored in the developing unit 2 blows out through these gaps, contaminating the interior of the apparatus or scattering the developer.

One of protection measures is that the clearance above the developing roller 3 is eliminated to prevent the inner pressure in the developing unit 2 from increasing. However, when the cover 203 is configured to have a leading edge put into contact with a surface of the photosensitive member 1*a,* the surface of the photosensitive member 1*a* is apt to be damaged by the leading edge, which is not desirable.

The present invention is proposed in consideration of the problems and provides an image forming apparatus capable of preventing a developer from scattering from a developing unit by preventing the air pressure in the developing unit from increasing without damaging a surface of a photosensitive member. Another object of the present invention is to provide a developing device capable of preventing a developer stored therein from scattering as well.

SUMMARY OF THE INVENTION

In order to attain an object, the present invention adopts an arrangement for regulating a clearance for a surface of a developer carrying member above the developer carrying member as stated later on. The present invention clarifies what extent of the clearance is effective, where a clearance regulated position should be located, to what extent a clearance regulated range is set, and what shape of a clearance regulating portion is preferable.

Specifically, the image forming apparatus according to the present invention is characterized in that the apparatus comprises:

a photosensitive member adapted to have an electrostatic latent image carried thereon;

a developing unit including a developer carrying member rotatable in a direction against gravity at a contacting point with or a point closest to the photosensitive member, and a cover for sealing a developer to be conveyed by the developer carrying member therein, the developer carrying member carrying and conveying the developer stored in the cover to develop the electrostatic latent image on the photosensitive member; and a clearance regulating member provided so as to be free from contact with a surface of the developer carrying member, the clearance regulating member regulating a clearance for an upper side of the developer carrying member;

wherein the clearance between the developer carrying member and the clearance regulating member is determined at a size not greater than a maximum height of the developer projected from the surface of the developer carrying member.

In accordance with the present invention, the clearance for the surface of the developer carrying member above the developer carrying member can be regulated by the clearance regulating member to restrict supply of air into the developing unit and restrain an increase in the air pressure in the developing unit, thereby preventing the developer from scattering from the developing unit.

The developer carrying member may be configured to be a developing roller, a brush, a belt and so on. The developer carrying member may be configured in any fashion as long as it rotates, carrying the developer thereon.

With respect to the rotational direction of the developer carrying member 3*a* rotatable in the direction against gravity at the contacting point with or the point closest to, the photosensitive member 1*a,* there are examples shown in FIGS. 19(*a*), (*b*), (*c*) and (*d*) with respect of combination of the developer car 3*a* with the photosensitive member 1*a* In the case of the developing unit 2 having the developer carrying member 3*a* rotating in such a rotational direction, the developer is apt to scatter since air is introduced into the developing unit 2 by rotation of the developer carrying member 3*a* to increase the inner pressure in the developing unit 2 as stated earlier. In the present invention, the clearance regulating member prevents air from being introduced. The inventors have found on experiments stated later that there are significant differences according to the extent in regulation of the clearance, and the inventors have attained the present invention.

The present invention provides not only the arrangement of the image forming apparatus but also the arrangement of a developing device as stated earlier. Specifically, according to one aspect of the invention, the developing device is characterized in that the device comprises a developer carrying member rotatable in a direction against gravity at a contacting point with, or a point closest to, a photosensitive member adapted to have an electrostatic latent image carried thereon, and a cover for sealing a developer to be conveyed by the developer carrying member in the cover, the developer carrying member carrying and conveying the developer stored therein to develop the electrostatic latent image on the photosensitive member; and the device further comprises at least a clearance regulating member provided so as to be free from contact with a surface of the developer carrying member, the clearance regulating member regulating a clearance for an upper side of the developer carrying member; wherein the clearance between the developer carrying member and the clearance regulating member is determined at a size not greater than a maximum height of the developer projected from the surface of the developer carrying member.

When the developer carrying member is configured to have magnetic poles, it is preferable, according to another aspect of the invention, that the clearance for the developer carrying member provided by the clearance regulating member is determined at a size not greater than a height of a magnetic brush of the developer at a magnetic pole just downstream of a clearance regulated position in terms of rotation of the developer carrying member.

BRIEF DESCRIPTION OF THE DRAWINGS

FIG. 17 is a schematic view of the arrangement of an image forming apparatus wherein a visual image formed on a photosensitive member is transferred onto a conveyed sheet and so on;

DETAILED DESCRIPTION OF THE PREFERRED EMBODIMENTS

Figure 1:
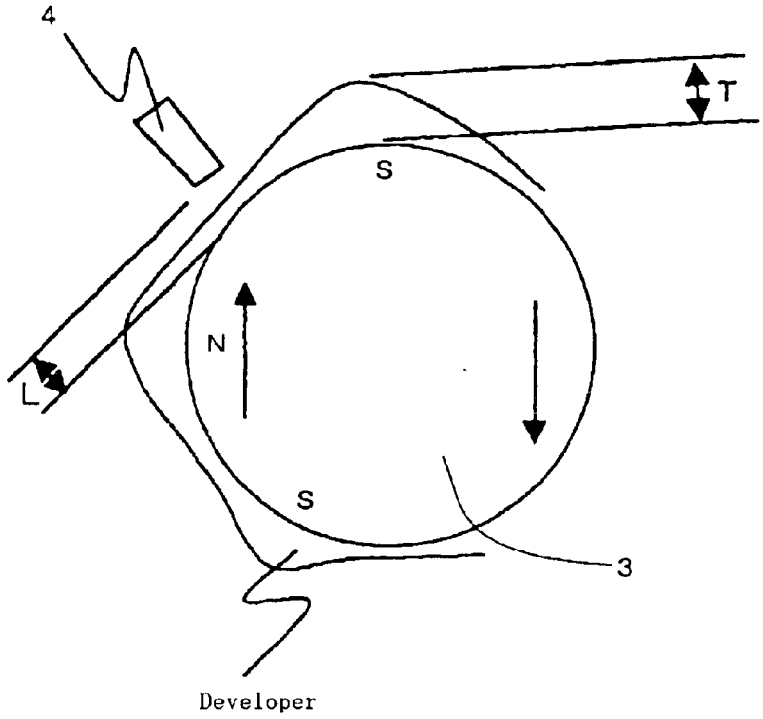
FIG. 1 is a schematic diagram showing how a developing roller and a clearance regulating member are provided according to the present invention.

Now, embodiments of the present invention will be described along with shown examples, The inventors have conducted experiments to measure an amount of a scattered developer with respect to different regulating amounts (clearance size) L for regulating the clearance above the developing roller 3 provided by the clearance regulating member 4 in the case of the developing unit 2 including a plurality of magnets in the developing roller 3 as shown in FIG. 1. The measurement of the amount of the scattered developer has been carried out by putting measurement members under both sides of the developing roller 3 and measuring the weight of the developer deposited on the measurement members. The measurement was carried out by rotating the developing roller 3 in the developing unit 2 in such a state that only the developing unit 2 was operated.

Figure 2:
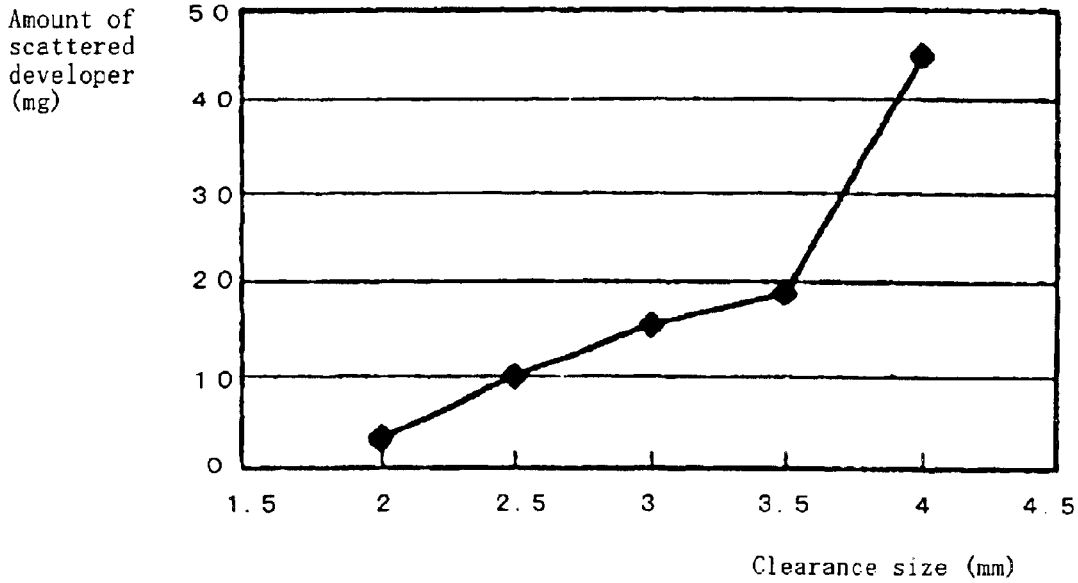
FIG. 2 is a graph showing correlation between an amount of a scattered developer and a clearance regulating amount.

FIG. 2 shows the results of an experiment. As shown in this figure, the amount of a scattered developer drastically decreases at a clearance size L of 3.5 mm as a threshold. At this threshold, the magnetic brush of the developer which was located at a magnetic pole just downstream of a position regulated by the clearance regulating member in terms of rotation of the developing roller 3 had a height T of 3.5 mm.

A similar experiment, which was carried out with the magnetic force of the developing roller 3 modified, shows that the amount of a scattered developer drastically decreases at a clearance size L of 3.0 mm as a threshold. At this threshold, the magnetic brush of the developer which was located at a magnetic pole just downstream of the position regulated by the clearance regulating member in terms of rotation of the developing roller 3 had a height T of 3.0 mm.

Another similar experiment, which was carried out with the magnetic force of the developing roller 3 further modified, shows that the amount of a scattered developer drastically decreases at a regulated value as a threshold. This regulated value was a clearance size L of 3.8 mm, and the magnetic brush of the developer which was located at a magnetic pole just downstream of the position regulated by the clearance regulating member in terms of rotation of the developing roller 3 had a height T of 3.8 mm.

Figure 3:
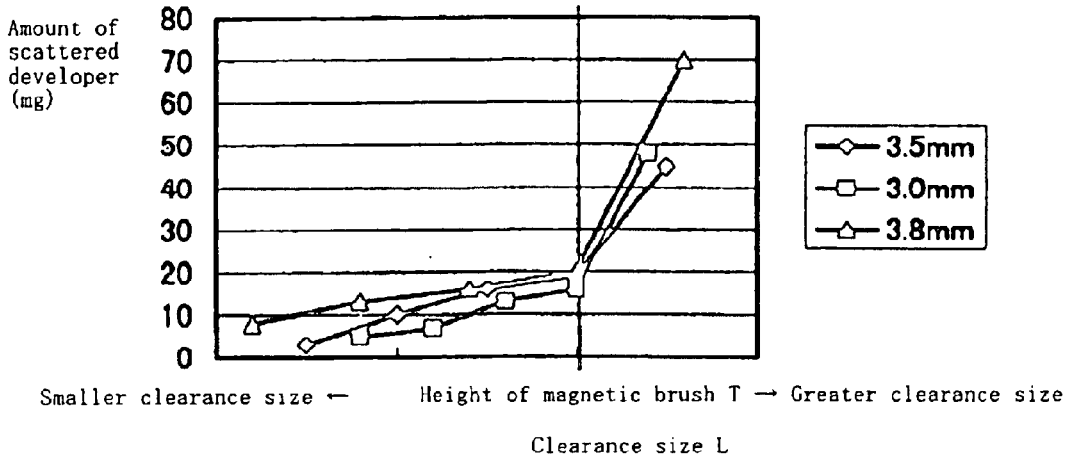
FIG. 3 is a collection of graphs showing the measured results of an amount of a scattered developer and a clearance size in heights of respective magnetic brushes in a single chart.

In other words, it has been found that the scattering of the developer can be drastically decreased by determining the regulating amount L for regulating the clearance above the developer carrying member 3*a* at a size not greater than the height T of the magnetic brush of the developer which is located at a magnetic pole just downstream of a clearance regulated position in terms of rotation of the developer carrying member 3*a*. FIG. 3 shows graphs of the measured results of the clearance size L and the amount of the scattered developer in the heights T of the respective magnetic brushes in a single chart, and each of graphs shows that the amount of the scattered developer decreases at a point where the clearance size L is determined at a size not greater than the size equal to the height T of each of the magnetic brushes.

Figure 4:
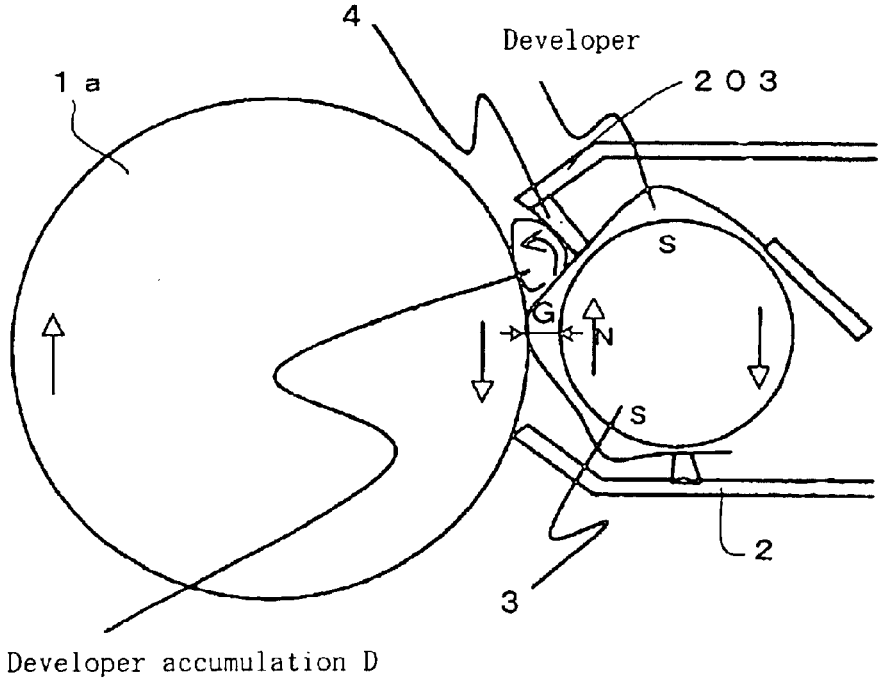
FIG. 4 is a schematic diagram showing a state wherein the clearance regulating member is provided so as to be in slight contact with a surface of a developing roller.

On the other hand, when the operation was carried out in such a state that the clearance regulating member 4 was provided so as to be in slight contact with a surface of the developing roller 3 as shown in FIG. 4, a developer accumulation D was produced between the photosensitive member 1*a* and the developer roller 3 as shown in this figure to deposit the developer on the photosensitive member 1*a,* providing an obstacle to printing. This means that the clearance regulating member 4 is required to be free from contact with the surface of the developer carrying member 3*a*.

The magnetic brush of the developer that was located at a magnetic pole just downstream of a clearance regulated position provided by the clearance regulating member in terms of rotation of the developer carrying member 3*a* is a projected portion of the developer, which projects from the surface of the developer carrying member 3*a* at the maximum height, and the portion that is determined at a size closest to the height T of that magnetic brush is a gap G between the developer carrying member 3*a* and the photosensitive member 1*a*.

The inventors have also carried out research on correlation of the gap G between the developing roller 3 and the photosensitive member 1*a* with the clearance between the developing roller 3 and the clearance regulating member 4 with respect to the amount of a scattered developer. The research has showed that the gap G between the developing roller 3*a* and the photosensitive member 1*a* also has a certain correlation with the clearance regulating amount L with respect to the amount of the scattered developer. Specifically, by determining the clearance for the developer carrying member 3*a* provided by the clearance regulating member 4 at a size not greater than the gap G between the developer carrying member 3*a* and the photosensitive member 1*a,* it becomes possible to drastically decrease the amount of the scattered developer as in the cases shown in FIGS. 2 and 3.

Further, the inventors have examined where the arrangement for regulating the clearance for the surface of the developer carrying member 3*a* should be provided to effectively decrease the amount of a scattered developer, and the inventors has come to the following conclusion.

Figure 5:
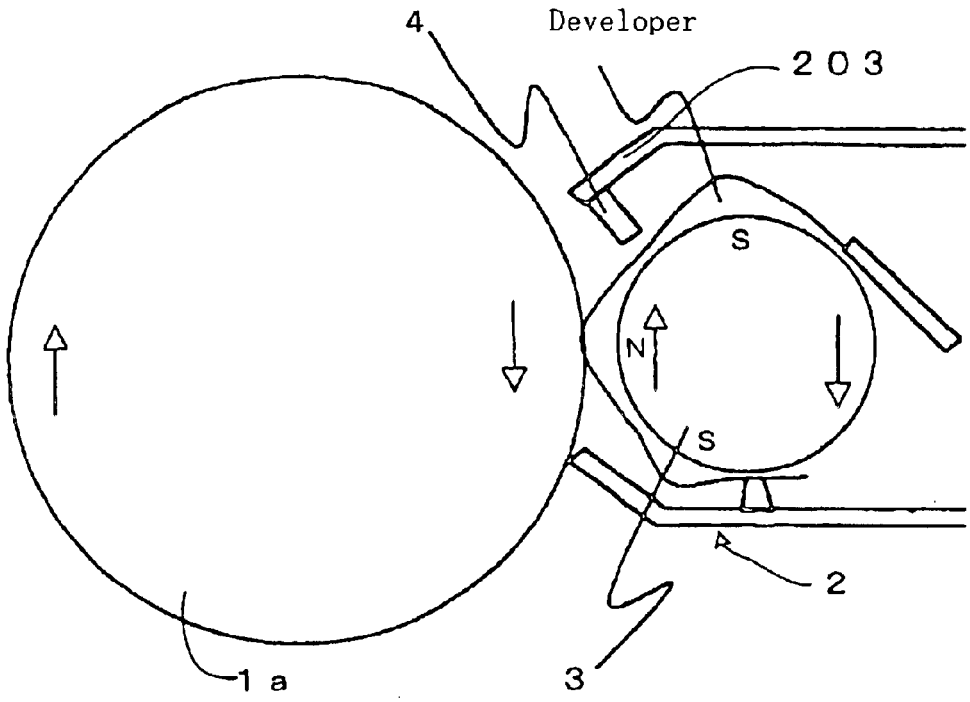
FIG. 5 is a schematic diagram showing a state wherein a clearance regulated position is determined between a magnetic developing pole and its downstream magnetic pole.

It has been found that when the developer carrying member 3*a* is configured to have magnetic poles, a position where the clearance is regulated by the clearance regulating member 4 can be located between a magnetic developing pole (an N pole in FIG. 5) and a magnetic pole (an S pole in the same figure) downstream of the magnetic developing pole as shown in FIG. 5 to decrease the amount of a scattered developer at the most effective fashion.

The reason why locating the clearance regulating member at this position is effective, is that the distance between the surface of the developer and the clearance regulating member 4 is constant at this location since a developer storm caused by magnetic poles in the developer carrying member 3*a* has no influence to the thickness of the layer of the developer at this location. In other words, the developer is shown in some figures to build up at the maximum at the magnetic developing pole and its subsequent downstream magnetic pole, where the magnetic brushes are produced as stated earlier. Actually, rotation of a sleeve on the surface of the developing roller 3 causes the developer to repeatedly collapse and build-up at these positions, producing a developer storm. On the other hand, the build up of the developer caused by the magnetic poles is not produced at an intermediate position between the magnetic developing pole and the subsequent magnetic pole, where the developer keeps a constant thickness since even rotation of the sleeve has no effects on the thickness of the developer. From this viewpoint, the clearance between the clearance regulating member 4 and the developer carrying member 3*a* can be always constant by determining such an intermediate position as the clearance regulated position.

Although both magnetic poles are, respectively, an N pole and an S pole in the shown examples, both magnetic poles may reverse in polarity or be the same in polarity.

Figure 6:
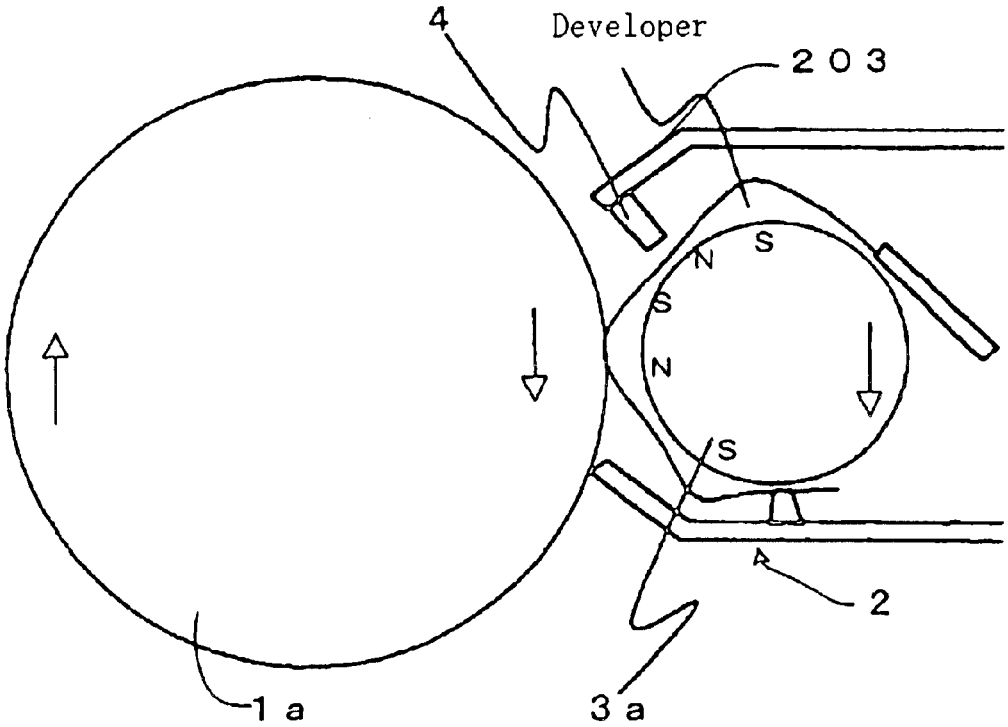
FIG. 6 is a schematic diagram showing a state wherein when magnetic poles are provided so that a first magnetic pole as a magnetic developing pole is followed by a second magnetic pole and a third magnetic pole in the downstream direction of the first magnetic pole, the clearance regulated position is located between the second magnetic pole and the third magnetic pole.

When the developer carrying member 3*a* has a plurality of magnetic poles provided in an upper portion thereof, the clearance regulated position provided by the clearance regulating member 4 may be located between a first magnetic and a second magnetic pole downstream of a magnetic developing pole in terms of rotation of the developer carrying member 3*a*. For example, when the magnetic poles are provided so that a first magnetic pole as the magnetic developing pole is followed by a second magnetic pole and a third magnetic pole in the downstream direction of the first magnetic pole as shown in FIG. 6, the clearance regulated position may be located between the second magnetic pole and the third magnetic pole. This is because the distance between the surface of the developer and the clearance regulating member 4 can be kept constant at this location as well since a developer storm caused by magnetic poles in the developer carrying member 3*a* has no influence to the thickness of the layer of the developer at this location as stated earlier.

Figure 7:
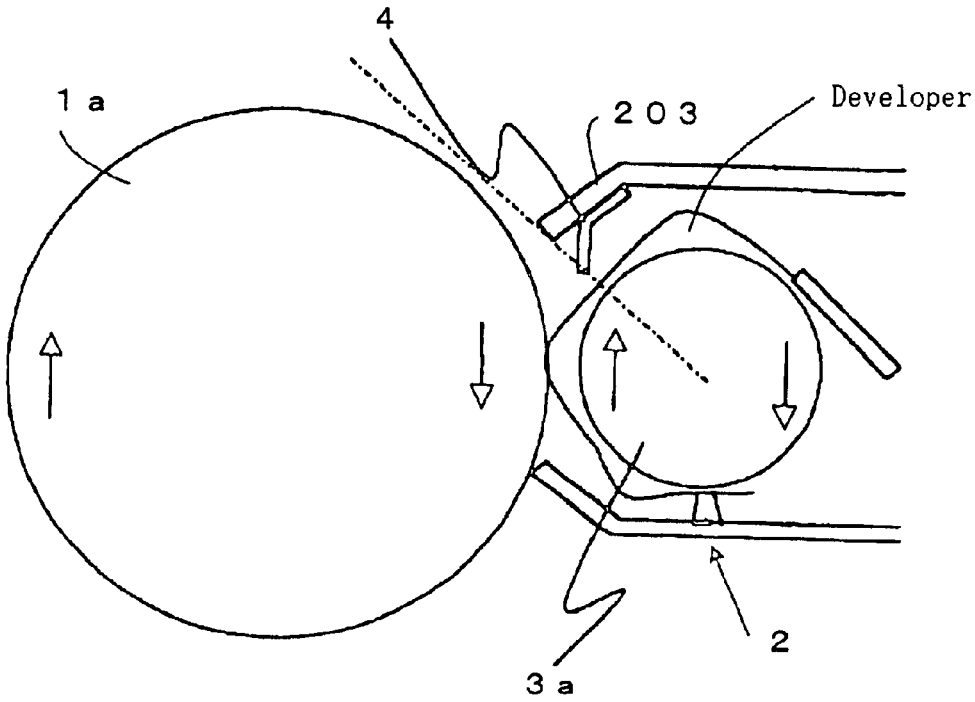
FIG. 7 is a schematic view showing an arrangement wherein the mounting location of the clearance regulating member 4 is determined on a side remote from a photosensitive member 1 with respect to a line connecting a leading edge of the clearance regulating member 4 and the center of a developer carrying member 3*a;*

It is preferable that the mounting location of the clearance regulating member 4 is determined on a side remote from the photosensitive member 1*a* with respect to a line connecting the leading edge of the clearance regulating member 4 and the center of the developer carrying member 3*a* as shown in FIG. 7. By mounting at this location, deformation, such as bending, can be applied to the clearance regulating member 4. Even if the clearance regulating member 4 per se does not have high rigidity, the deformation can be applied to the clearance regulating member to increase the rigidity of the clearance regulating member. As a result, the clearance regulating member can carry out stable clearance regulation, which is quite effective to reduce the scattering of the developer.

Figure 8:
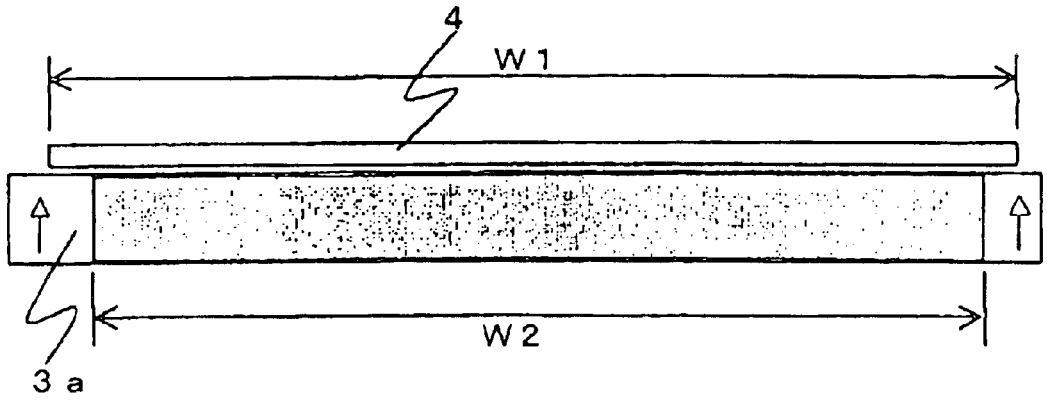
FIG. 8 is a schematic view showing a state wherein a regulating width W1 for a clearance above a developer carrying member 3*a* is determined at a size not smaller than a developing width W2 on the developer carrying member.

Next, the inventors have examined how wide the range where the clearance is regulated by the clearance regulating member should be, and the inventors have come to the conclusion that a regulating width W1 for the clearance above the developer carrying member 3*a* needs to be determined at a size not smaller than a developing width W2 on the developer carrying member 3*a* as shown in FIG. 8. This is because when the clearance regulating member 4 has such a determined width, both ends of the developing width W2 on the developer carrying member 3*a,* where the scattering amount of the developer becomes the greatest, can be regulated by the clearance regulating member, thereby effectively restraining the developer from scattering.

Figure 9:
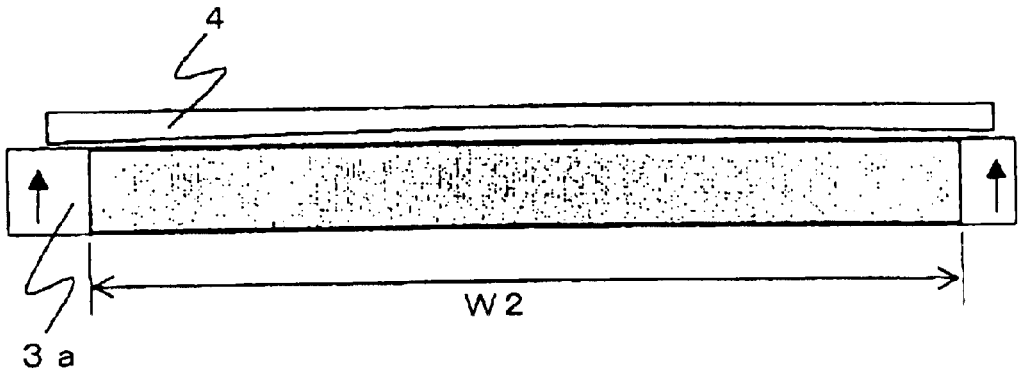
FIG. 9 is a schematic view showing an arrangement wherein the leading edge of the clearance regulating member is formed so as to have a greater original clearance at a central position than portions adjacent to both ends of the developer carrying member.

In addition, the inventors have examined what is a preferable shape for the portion where the clearance is regulated by the clearance regulating member. In conclusion, when a cover 203 of the developing unit tends to become closer to a central portion of the developer carrying member 3*a* in terms of shape due to, e.g., deformation affected by heat, it is preferable that the leading edge of the clearance regulating member is formed so as to have a greater original clearance at a central portion than portions adjacent to both ends of the developer carrying member 3*a* as shown in FIG. 9 for compensating deformation. Thus, the clearance regulation can be provided in stable fashion, and the developer be effectively restrained from scattering.

Figure 10:
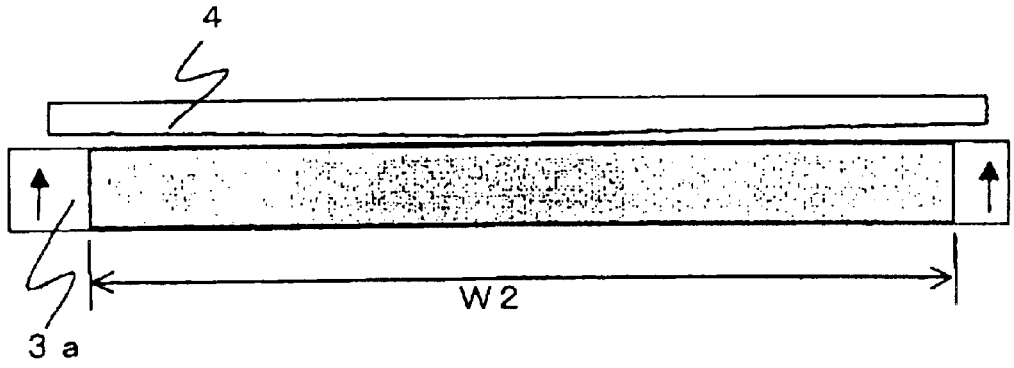
FIG. 10 is a schematic view showing an arrangement wherein the leading edge of the clearance regulating member is formed so as to have a smaller original clearance at the central portion than the portions adjacent to both ends of the developer carrying member.

Conversely, when the cover 203 of the developing unit tends to become away from a central portion of the developer carrying member 3*a* in terms of shape due to deformation, it is preferable in conclusion that the leading edge of the clearance regulating member is formed so as to have a smaller original clearance at the central portion than the portions close to both ends of the developer carrying member 3*a* as shown in FIG. 10. Thus, it becomes possible to compensate deformation. The clearance regulation can be provided in stable fashion, and the developer can be effectively restrained from scattering.

Figure 11:
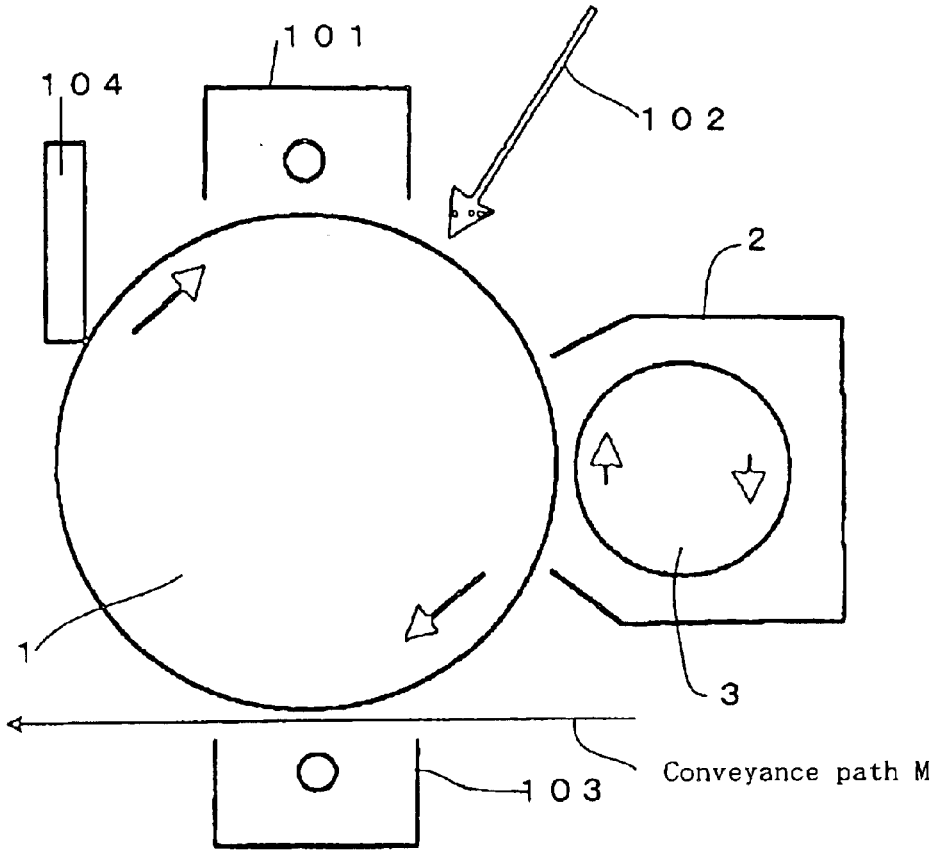
FIG. 11 is a schematic view of the printer according to an embodiment of the present invention.

FIG. 11 is a schematic view of the arrangement of a printer with an electrophotographic process as an embodiment of the present invention. In this Figure, reference numeral 1 designates a photosensitive drum, reference numeral 2 designates a developing unit, reference numeral 3 designates a developing roller provided in the developing unit, reference numeral 101 designates a corona charger for providing charges with the photosensitive drum 1 to charge the drum, reference numeral 102 designates an LED head for carrying out exposure for forming a latent image, reference numeral 103 designates a transfer unit wherein an image on the photosensitive drum 1 that is developed to be visualized is transferred onto a sheet, and reference numeral 104 designates a cleaning unit for removing and collecting a residual developer on the photosensitive drum 1. In this figure, a symbol M designates a sheet conveyance path. The photosensitive drum 1 rotates in the clockwise direction on this Figure. The corona charger 101, which is provided above the photosensitive drum 1, charges a drum surface. The LED head 102 carries out exposure to form an electrostatic latent image. Then, the developing roller 3 of the developing unit 2 causes a developer to adhere to the electrostatic latent image to form a visual image. After that, in the transfer unit 103, the visual image on the photosensitive drum 1 is transferred onto a sheet, which is conveyed by the conveyance path M in a direction indicated by an arrow in this figure. A portion of the developer that has not been transferred onto the sheet at that time is removed and collected by the cleaning unit 104.

Figure 12:
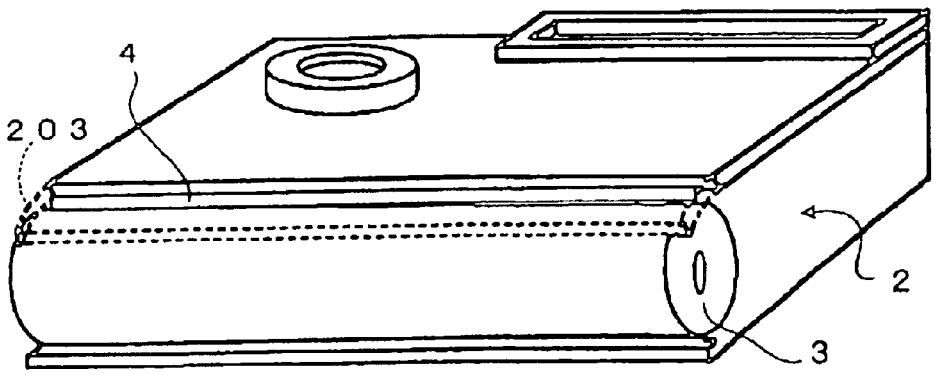
FIG. 12 is a perspective view of a developing unit 2.
Figure 13:
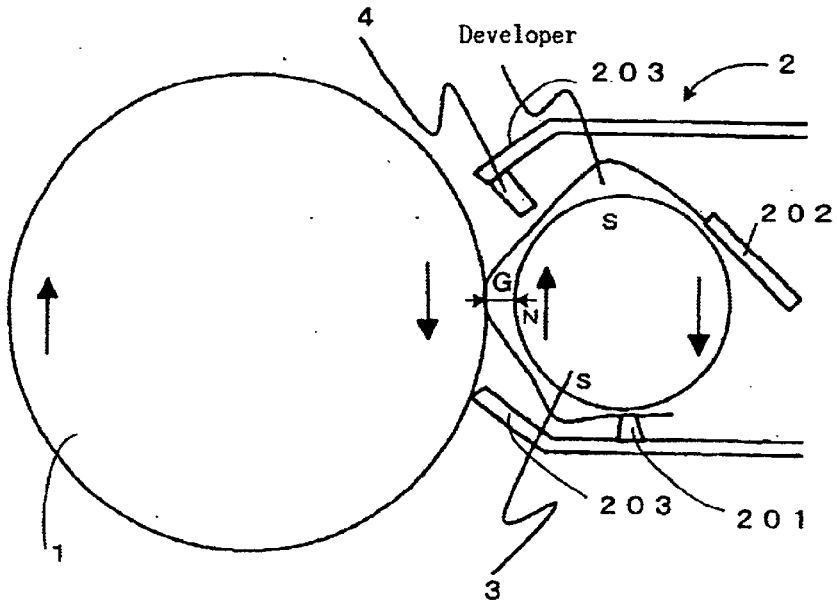
FIG. 13 is a schematic diagram showing a state wherein developing treatment is carried out between the developing unit 2 and a photosensitive drum 1.

FIG. 12 is a perspective view of the developing unit 2, and FIG. 13 is a schematic diagram showing a state wherein exposure treatment is carried out between the developing unit 2 and the photosensitive drum 1. In the shown example, the photosensitive drum 1 and the developing roller 3 are both rotating in the clockwise direction. Referring to FIG. 13, the developer, which has been stored in the developing unit 2 and has been charged by stirring therein, is conveyed from a lower right side by the developing roller 3, and a conveyance amount of the developer is regulated to a certain extent by a developer regulating blade 201. Further, the developer is conveyed to the photosensitive drum 1 by the developing roller 3. The latent image portion on the photosensitive drum 1, which is used for printing an image or a letter, has the developer deposited thereon, and the latent image is developed at that time. A portion of the developer that has not been used for developing is further conveyed by the developing roller 3 and is scraped from the developing roller 3 by a developer collecting blade 202. The developer thus scraped is mixed with the developer stored in the developing unit 2, and the mixture is stirred to be charged. This process is repeated to carry out image formation on the photosensitive drum 1.

A portion of developing roller 3 appears from such a type of developing unit 2, and the remaining portion of the developing roller are covered by resin covers 203. Although the covers 203 forming the respective sides are connected each other, the covers cannot provide a complete seal for a reason in manufacture. Between upper and lower portions of the developing roller 3 and corresponding covers 203, clearances are required so that the developing roller 3 can rotates without hindrance.

Figure 14:
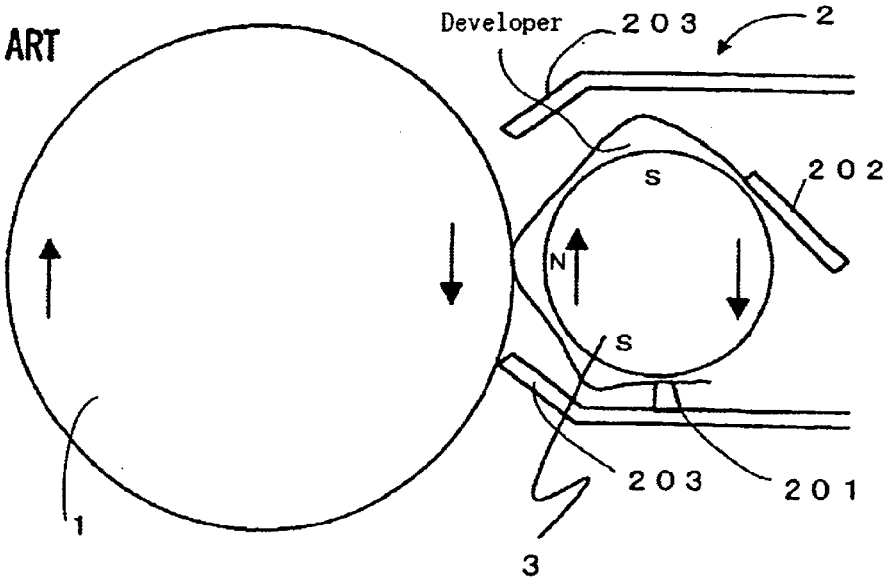
FIG. 14 PRIOR ART
FIG. 14 is a schematic diagram showing how the developing roller 3 and the developing unit cover 203 thereabove are provided in the conventional arrangement.

In a conventional arrangement, the distance between the developing roller 3 and the cover 203 of the developing unit 2 above the developing roller is relatively great as shown in FIG. 14. On the other hand, in accordance with the arrangement of the present invention, a clearance regulating member 4 is provided at a position above the developing roller 3 on a side close to the photosensitive drum 1 to regulate the clearance between the developing roller 3 and the clearance regulating member 4 as shown in FIG. 13.

The regulating amount L of the clearance is determined to be smaller than the height T of the magnetic brush at a magnetic pole located just downstream of the clearance regulated position based on the experimental results stated earlier. In this example, the height T of the magnetic brush is 3.5 mm while the clearance regulating member 4 has a leading edge determined so that the clearance between the leading edge of the clearance regulating member 4 and the developing roller 3 is smaller than 3.5 mm. Thus, the amount of a scattered developer is drastically reduced as shown in FIG. 2, and the scattering amount is significantly decreased in comparison with conventional apparatuses shown in FIG. 14. In the case of a conventional apparatus, the clearance between the cover 203 and the developing roller 3 is greater than 3.5 mm. The distance between the developing roller 3 and the photosensitive drum 1 is 3.5 mm. The thickness of a developer layer at this clearance regulated position is 1.5 mm, and the clearance size is determined so as to be greater than 1.5 mm. This is because a developer is prevented from adhering to a surface of the photosensitive drum 1 for avoiding an obstacle to printing on the ground of that, when the leading edge of the clearance regulating member 4 gets in contact with the developer, the developer accumulation D is produced as stated earlier.

In this embodiment, the clearance regulating member is located so that the leading edge of the clearance regulating member 4 is located between an N pole as the magnetic developing pole of the developing roller 3 and an S pole as a magnetic pole downstream of the magnetic developing pole in terms of rotation of the developing roller 3 as shown in FIG. 13. As stated earlier, the distance between the surface of the developer and the clearance regulating member 4 is constant at this location since a developer storm caused by magnetic poles in the developing roller 3 has no influence to the thickness of the layer of the developer at this location. From this viewpoint, this location is the optimum location to regulate the clearance for preventing air from entering the developing unit 2.

When magnetic poles are provided so that a first magnetic pole as the magnetic developing pole is followed by a second magnetic pole and a third magnetic pole in the downstream direction of the first magnetic pole as shown in FIG. 6, the clearance regulated position provided by the clearance regulating member 4 may be located between the second magnetic pole and the third magnetic pole. This is because the distance between the surface of the developer and the clearance regulating member 4 can be kept constant at this location as well since a developer storm caused by magnetic poles in the developing roller 3 has no influence to the thickness of the layer of the developer at this location as stated earlier.

Figure 15:
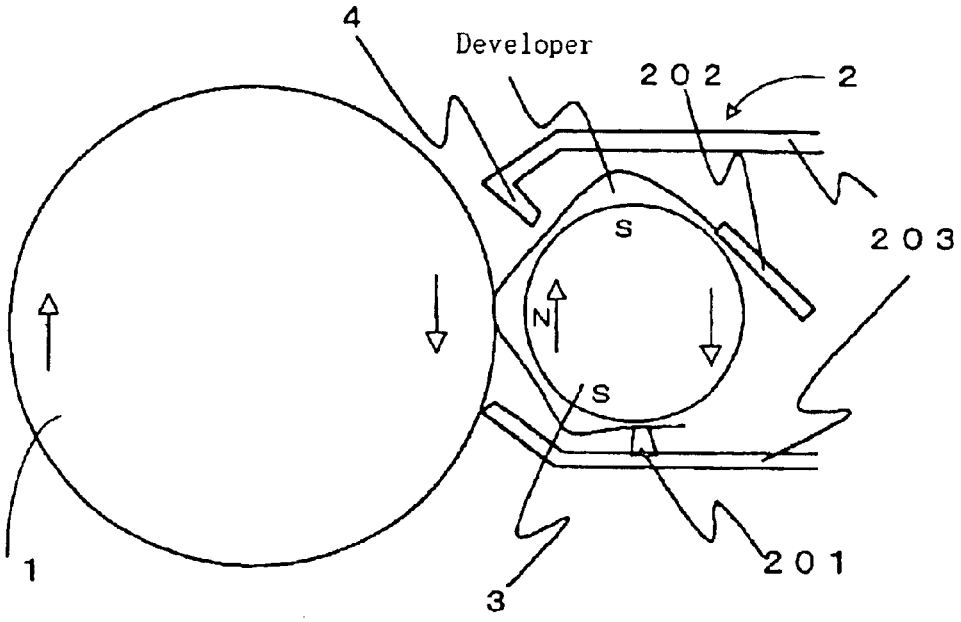
FIG. 15 is a schematic diagram showing another embodiment of the present invention wherein the clearance regulating member 4 is formed from the developing unit cover 203.

FIG. 15 shows another embodiment according to the present invention. As shown in this Figure, the clearance regulating member 4 is formed from a cover 203 of the developing unit 2. Specifically, the cover 203 has a leading edge projecting toward the developing roller 3. This arrangement can restrain the clearance regulating member 4 from being deformed, which can not be overcome by a method to provide the cover 203 with the clearance regulating member 4 as a separate part. Thus, the cover 203 of the developing unit can have required rigidity as a whole, which leads to establishing of stable clearance regulation and to great contribution to a reduction in the scattered developer.

Figure 16:
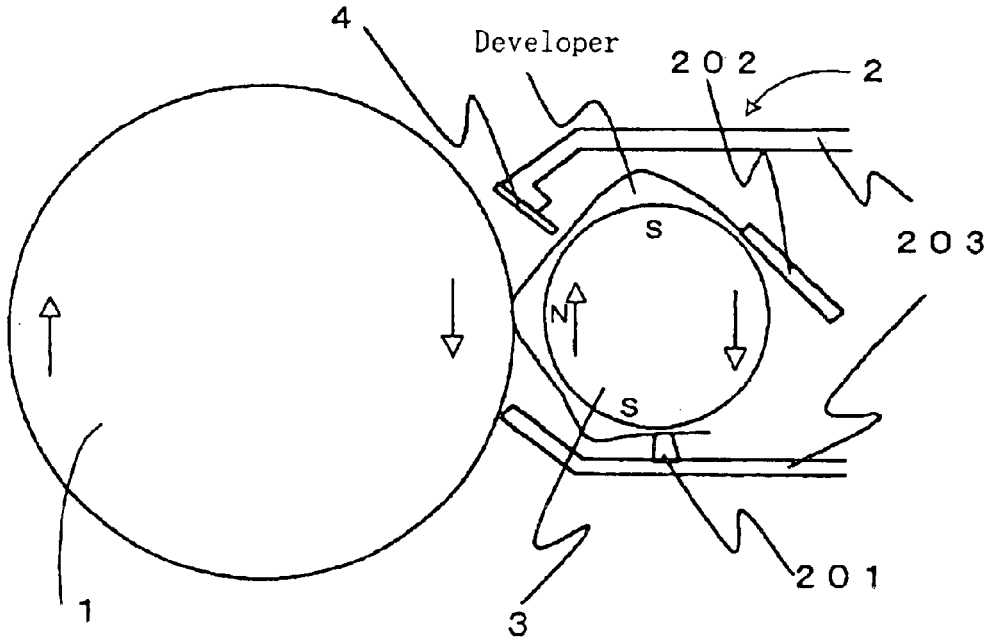
FIG. 16 is a schematic diagram showing a state wherein the clearance regulating member 4 and the developing unit cover 203 are made of the same material.
Figure 17:
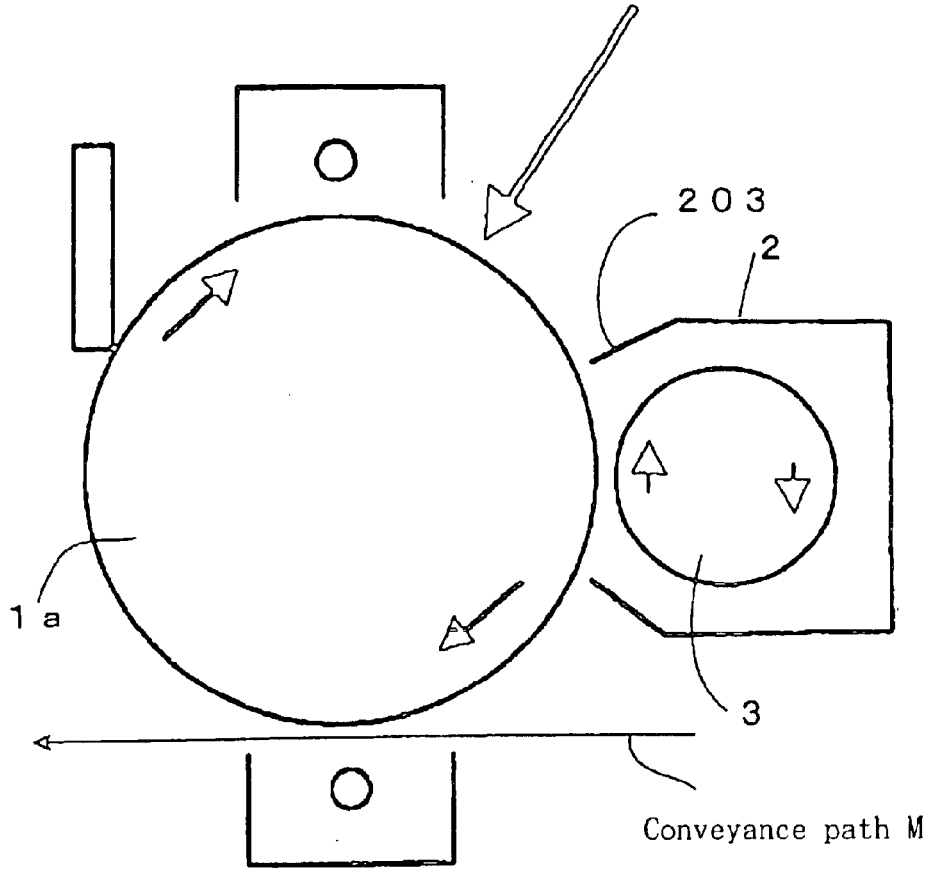
Figure 18:
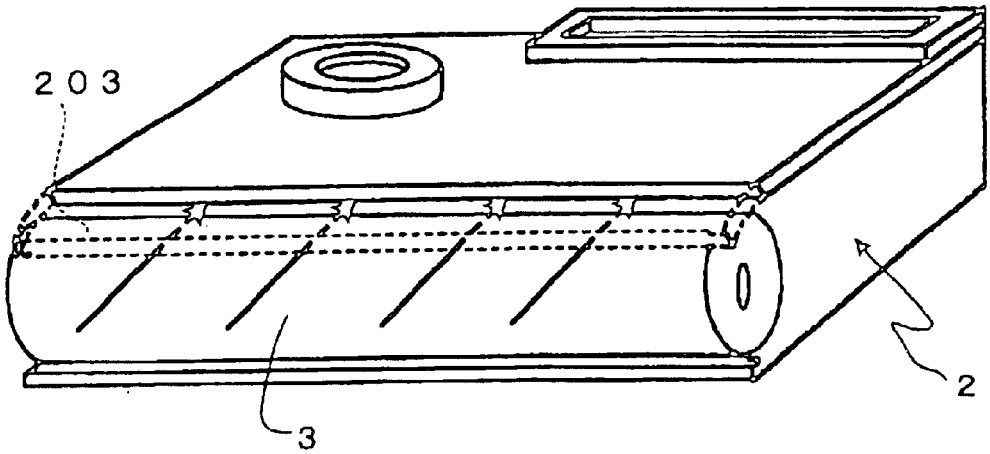
FIG. 18 is a perspective view showing how a developer carrying member of the developing unit and a lid thereabove are provided.
Figure 19A:
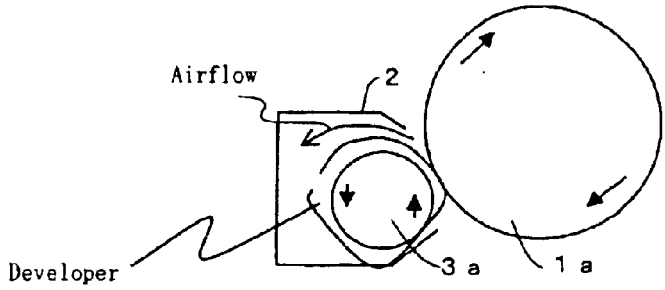
FIG. 19 is a collection of schematic diagrams showing examples of combinations of the photosensitive member with the developer carrying member rotatable in a direction against gravity at a contacting point with, or at a point closest to, the photosensitive member.
Figure 19B:
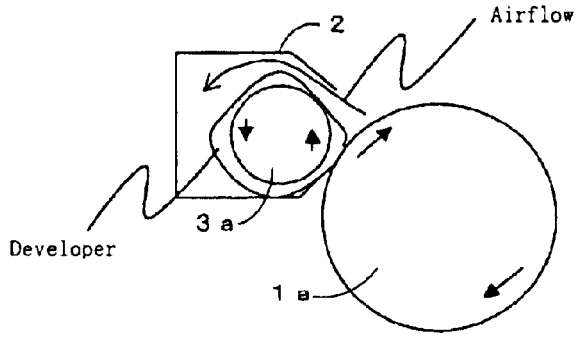
Figure 19C:
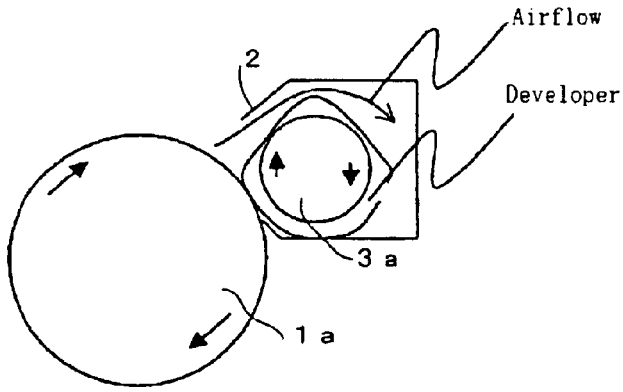
Figure 19D:
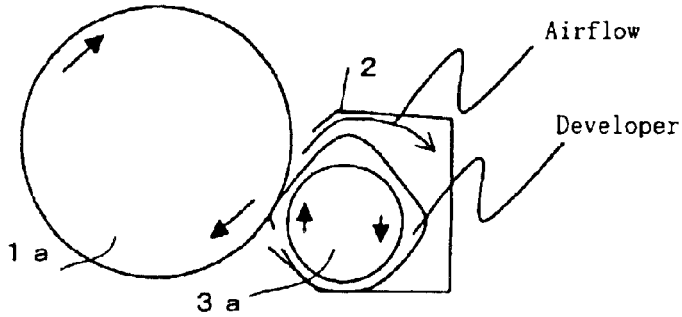

As another arrangement similar in principle to that shown in FIG. 15, the clearance regulating member 4 and the cover 203 of the developing unit may be made of the same material to restrain the clearance regulating member 4 from being deformed as shown in FIG. 16. By forming both members from the same material, the clearance regulating member 4 can be restrained from being deformed, and stable clearance regulation can be provided, which leads to contribution to a reduction in the scattered developer. This arrangement gives particularly significance against affection by environment. If both members are made of different materials, putting or using both members repeatedly at a low temperature and at a high temperature causes both members to be deformed by gradual build-up of stress due to a difference in contractility. This arrangement and the arrangement shown in FIG. 15 are appropriate to avoid such deformation.

When the cover 203 is likely to be greatly deformed, the deformation can be restrained by forming the clearance regulating member 4 and the cover 203 for the developing unit from different material in some cases. Specifically, when the cover 203 is likely to be greatly deformed, a cover 203 having a low deformation ratio can be employed to become useful in compensation to the deformation of the cover 203 for the developing unit. Thus, stable clearance regulation can be attained, and the developer can be effectively restrained from scattering.

When the clearance regulating member is made of a material different from the cover, it becomes easy to mount the clearance regulating member to the cover 203 of the developing unit and to adjust the mounting position and the mounting state of the clearance regulating member by forming the clearance regulating member from, e.g., a Mylar sheet as a flexible material. Of course, the cover 203 of the developing unit may be also formed from a Mylar sheet, which is the similar material as the clearance regulating member 4.

The clearance regulating member 4 may be formed from a material having high rigidity, such as SUS, which is different from the material forming the cover 203. When the clearance regulating member is formed from a material having high rigidity, such as SUS, the clearance regulating member can provide stable clearance regulation without being affected by deformation caused in the cover 203 of the developing unit. This arrangement is quite effective in a reduction in a scattered developer. Of course, the cover 203 of the developing unit may be formed from a material having high rigidity, such as SUS, as in the clearance regulating member 4.

When the clearance regulating member 4 is mounted so that the mounting location of the clearance regulating member 4 is determined on a side remote from the photosensitive drum 1 with respect to a line connecting the leading edge of the clearance regulating member 4 and the center of the developer roller 3 as shown in FIG. 7, the clearance regulating member 4 is allowed to be formed in, e.g., a dogleg shape or an L-character shape as shown in this figure. Even if the clearance regulating member 4 per se does not have high rigidity, this arrangement can increase the rigidity of the clearance regulating member. The clearance regulating member can provide stable clearance regulation as in the case of utilizing a material having high rigidity, such as SUS. This arrangement is quite effective to reduce the scattering of the developer.

In addition, the regulating width W1 for the clearance above the developing roller 3 is determined to be a size not smaller than the developing width W2 on the developing roller 3 as shown in FIG. 8. This is because the amount of a scattered developer becomes great at both ends of the developing width W2 on the developing roller 3, and because the clearance regulating member can provide both ends with regulation to reduce the scattering of the developer. From this viewpoint, this arrangement is commonly applicable to all embodiments stated earlier.

In addition, the leading edge of the clearance regulating member 4, which regulates the clearance size above the developing roller, needs to be formed so as to have a greater original clearance at a central portion than portions close to both ends of the developing roller 3 as shown in FIG. 9 in some cases. This measure is provided in consideration of deformation in the cover 203 of the developing unit due to influence by heat. In other words, when the cover 203 of the developing unit tends to become closer to the central portion of the developing roller 3 due to deformation, such an arrangement is adopted to establish stable clearance regulation and to effectively restrain the developer from scattering.

The leading edge of the clearance regulating member may be designed to be formed so as to have a smaller original clearance at the central portion as shown in FIG. 10. This measure is also provided in consideration of deformation in the cover 203 of the developing unit due to influence by heat. Specifically, when the cover 203 of the developer unit tends to become away from the central portion of the developing roller 3 in terms of shape, this measure is adopted to establish stable clearance regulation and to effectively restrain the developer from scattering.

The arrangement of FIG. 9 and the arrangement of FIG. 10 are provided in consideration of the presence of contrary deformation in the cover 203 of the developing unit. Both arrangements are adopted when deformation becomes great due to influence by, e.g. heat. Since anisotropy is caused in some materials in terms of tensile strength and so on, it is necessary to select one of the arrangements after checking in which direction the deformation becomes significant.

The image forming apparatus according to the present invention is not limited to only the embodiments stated earlier. Variations and modifications are possible without departing the spirit of the invention.

As explained, when the clearance regulating member, which can regulate the clearance for the surface of the developer carrying member, is provided above the developer carrying member in accordance with the arrangement of the image forming apparatus of the present invention, an unknown clearance regulating size can be provided in the certain range, offering an advantage in that the scattering of the developer from the developing unit is extremely reduced.

Addition, in order to reduce the scattering of the developer, it is effective that the position where the clearance is regulated by the clearance regulating member is located between the magnetic developing pole and the magnetic pole downstream of the magnetic developing pole in terms of rotation of the developer carrying member. This is because the clearance regulation is carried out at the location where the distance between the surface of the developer and the clearance regulating member is constant due to the absence of influence by a developer storm.

Further, when the regulating width, which is provided by the clearance regulating member for the clearance above the developer carrying member, is determined at a size not smaller than the developing width on the developer carrying member, the clearance regulating member can regulate both ends of the developing width on the developer carrying member where the amount of the scattering developer is the greatest. It becomes possible to effectively prevent the developer from scattering.

As explained, the image forming apparatus and the developing device according to the present invention are effective as arrangements to prevent a developer from scattering in an apparatus for forming an image, such as copying machines, facsimile machines, printers and other information processing systems. The image forming apparatus and the developing device are appropriate to prevent the entrance of air into the developing unit, which has created the problem particularly in the case wherein the developer carrying member in the developing unit rotates in a direction against gravity at a contacting point with or a point closest to the photosensitive member.

What is claimed is:

1. An image forming apparatus comprising:

a photosensitive member adapted to have an electrostatic latent image carried thereon;

a developing unit including a developer carrying member rotatable in a direction against gravity at a contacting point with, or a point closest to, the photosensitive member, and a cover for sealing a developer to be conveyed by the developer carrying member therein, the developer carrying member carrying and conveying the developer stored in the cover to develop the electrostatic latent image on the photosensitive member; and a clearance regulating member provided so as to be free from contact with a surface of the developer carrying member, the clearance regulating member regulating a clearance for an upper side of the developer carrying member;

wherein the clearance between the developer carrying member and the clearance regulating member is determined at a size not greater than a maximum height of the developer projected from the surface of the developer carrying member and the clearance regulating member is free from contact with the developer formed on said developer carrying member.

2. The image forming apparatus according to claim 1, wherein when the developer carrying member is configured to have magnetic poles, the clearance for the developer carrying member provided by the clearance regulating member is determined at a size not greater than a height of a magnetic brush of the developer at a magnetic pole just downstream of a clearance regulated position in terms of rotation of the developer carrying member.

3. The image forming apparatus according to claim 1, wherein the clearance for the developer carrying member provided by the clearance regulating member is determined at a size not greater than a gap between the developer carrying member and the photosensitive member.

4. The image forming apparatus according to claim 1, wherein when the developer carrying member is configured to have magnetic poles, a position where the clearance is regulated by the clearance regulating member is located between a magnetic developing pole and a magnetic pole downstream of the magnetic developing pole in terms of rotation of the developer carrying member.

5. The image forming apparatus according to claim 1, wherein the clearance for the upper side of the developer carrying member provided by the clearance regulating member has a width not smaller than a developing width on the developer carrying member.

6. A developing device comprising a developer carrying member rotatable in a direction against gravity at a contacting point with or a point closest to a photosensitive member adapted to have an electrostatic latent image carried thereon, and a cover for sealing a developer to be conveyed by the developer carrying member in the cover, the developer carrying member carrying and conveying the developer stored therein to develop the electrostatic latent image on the photosensitive member; and further comprising at least a clearance regulating member provided so as to be free from contact with a surface of the developer carrying member, the clearance regulating member regulating a clearance for an upper side of the developer carrying member; wherein the clearance between the developer carrying member and the clearance regulating member is determined at a size not greater than a maximum height of the developer projected from the surface of the developer carrying member and the clearance regulating member is free from contact with the developer formed on said developer carrying member.

7. The developing device according to claim 6, wherein when the developer carrying member is configured to have magnetic poles, the clearance for the developer carrying member provided by the clearance regulating member is determined at a size not greater than a height of a magnetic brush of the developer at a magnetic pole just downstream of a clearance regulated position in terms of rotation of the developer carrying member.

* * * * *